US005890538A

United States Patent [19]

Beirute et al.

[11] Patent Number: 5,890,538

[45] Date of Patent: Apr. 6, 1999

[54] REVERSE CIRCULATION FLOAT EQUIPMENT TOOL AND PROCESS

[75] Inventors: Robert M. Beirute; John W. Kearns, Jr., both of Tulsa, Okla.

[73] Assignee: Amoco Corporation, Chicago, Ill.

[21] Appl. No.: 837,203

[22] Filed: Apr. 14, 1997

[51] Int. Cl.[6] ..... E21B 34/10

[52] U.S. Cl. ..... 166/285; 154/177.4

[58] Field of Search ..... 166/285, 154, 166/177.4, 318, 242.8, 291, 292, 293

[56] References Cited

U.S. PATENT DOCUMENTS

| | | | |
|---|---|---|---|
| 1,955,113 | 4/1934 | Davenport | 166/9 |
| 2,675,082 | 4/1954 | Hall | 166/22 |
| 2,717,648 | 9/1955 | Baker | 166/225 |
| 2,718,265 | 9/1955 | Conrad | 166/225 |
| 2,884,938 | 5/1959 | Hildebrandt | 137/68 |
| 3,385,370 | 5/1968 | Knox et al. | 166/225 |
| 4,338,999 | 7/1982 | Carter, Jr. | 166/117 |
| 4,548,271 | 10/1985 | Keller | 166/291 |
| 4,664,192 | 5/1987 | Hogarth | 166/154 |
| 4,683,955 | 8/1987 | Stepp et al. | 166/327 |
| 5,062,481 | 11/1991 | Gullett | 166/242.8 |
| 5,277,255 | 1/1994 | Bell | 166/290 |
| 5,333,690 | 8/1994 | Nahm et al. | 166/291 |
| 5,472,053 | 12/1995 | Sullaway et al. | 166/327 |
| 5,494,107 | 2/1996 | Bode | 166/285 |
| 5,501,280 | 3/1996 | Brisco | 166/373 |
| 5,511,618 | 4/1996 | Budde | 166/321 |

FOREIGN PATENT DOCUMENTS

| | | |
|---|---|---|
| 0658261 | 4/1979 | U.S.S.R. . |
| 1375801A1 | 5/1985 | U.S.S.R. . |
| 1723309A1 | 6/1990 | U.S.S.R. . |
| 2147641 | 5/1985 | United Kingdom . |

*Primary Examiner*—William Neuder

*Attorney, Agent, or Firm*—Welsh & Katz. Ltd.; Thomas W. Tolpin

[57] ABSTRACT

A user-friendly reverse circulation float equipment tool and process permit the application of reverse circulation cementing in shallow or deeper wells, without having to use an inner string. The reverse circulation float equipment tool can have: an upper section with a ball-activated upper valve, a lower section with a ball-activated lower valve, and an intermediate ball chamber between the upper and lower sections to contain the ball in a reverse mode. The reverse circulation float equipment tool and process allow circulation in the normal and reverse circulation modes while running the casing and during hole conditioning. After the reverse circulation job, the convenient reverse circulation float equipment tool and process allow closing of the bottom of the casing to prevent U-tubing of the cement slurry. This will also facilitate having the casing in radial compression during the time required to set the cement in the annulus, between the casing and wall of the well bore, to minimize the formation of a micro-annulus during cement curing.

16 Claims, 5 Drawing Sheets

REVERSE CIRCULATION FLOAT EQUIPMENT TOOL AND PROCESS

BACKGROUND OF THE INVENTION

This invention pertains to cementing of oil and gas well and, more particularly, to a reverse circulation equipment tool and process.

In the construction of oil and gas wells, a well bore is drilled into one or more subterranean formations or zones containing oil and/or gas to be produced. The well bore is typically drilled utilizing a drilling rig which has a rotary table on its floor to rotate a pipe string during drilling and other operations. The drilling rig may also have a top drive mechanism for rotating the pipe string which is integral with the traveling block of the rig in addition to or instead of a rotary table.

During a well bore drilling operation, drilling fluid, also referred to as drilling mud, is circulated through nozzles on the drill bit and upwardly back to the surface through the annulus between the walls of the well bore and the drill string. The drilling mud is typically either water-base or oil-base and contains a variety of components. The primary functions of the drilling mud are to lubricate the drill bit, to transport rock cuttings to the surface and to maintain a hydrostatic pressure in the well-bore sufficient to prevent the intrusion of formation fluids and thereby prevent blowouts.

Following drilling, a casing or pipe is cemented in the well-bore to prevent caving in of the hole and to segregate the formations penetrated. Typically, after a well for the production of oil and/or gas has been drilled, a casing will be lowered into and cemented in the well. The weight of the casing, particularly with deep wells, creates a tremendous amount of stress and strain on the equipment used to lower the casing into the well. In order to minimize that stress, floating equipment, such as float shoes and/or float collars can be used in the casing string.

The float equipment typically has a valve affixed to the casing which allows fluid to flow down through the casing, but prevents flow in the opposite direction. Because upward flow is obstructed, a portion of the weight of the casing will float or ride on the well fluid to reduce the amount of weight carried by the equipment lowering the casing into the well. Once the casing is in position, cement is pumped down through the inner diameter of the casing, through the valve and into the annular space between the outer diameter of the casing and the well bore. After the cement job is complete, the valve keeps the cement below and behind the casing string.

The float equipment is typically fabricated with a check valve in an outer sleeve which is screwed into a casing string. The valve can be affixed by filling the annulus between the valve housing and the outer sleeve with a high compressive strength cement to form a cement body portion.

As discussed above, in running a string of well casing in a well bore, it is often the practice to cause the well fluid to sustain a portion of the weight of the casing string by floating the string in the well fluid. The well fluid is ordinarily prevented from entering the casing string by an upwardly closing check valve, which later prevents back flow of the cement slurry, pumped down and around the casing string by conventional cementing.

A shoe on the lower end of a string of casing can be provided in order to guide the casing through the well bore and protect the casing from damage by contact with the wall of the well bore. Sometimes the openings on the sides of the shoe help jet the well bore walls for improved cleanings. In some circumstances, it has been the practice to use a type of shoe with a valve which either totally excludes well fluid from the interior of the casing string or which permits a limited amount of fluid to enter the string. Shoes of this type are often referred to as float shoes and differential flat shoes, respectively.

It is the usual practice to cement the casing in place to prevent migration or channeling of water or other fluids along the outer side thereof. Before cementing, annular space between the outside of the casing and the wall of the borehole is the conditioned for cementing by pumping conditioning fluid down the casing. The conditioning fluid flows radially outwardly from the bottom of the casing and passes-upwardly through the annular space where it entrains and carries rock cuttings and other to the surface. The conditioning fluid usually comprises drilling mud followed by thinner drilling mud of lesser viscosity which can more easily be displaced during cementing.

Conventional cementing techniques involve displacing cement slurry down through the bore of the casing and out a shoe on the bottom thereof so that the cement fills the annulus between the casing and the well-bore wall. A sufficient volume of slurry is displaced so that the top of the cement in the annulus extends inside the previously cemented string of casing. The casing is made up of a number of cylindrical sections or joints which are passed down the hole in sequence and which are screwed together end-to-end. As one moves down to lower depths the diameter of the casing is reduced. It often is the practice to run a number of lengths of casing of constant diameter into the hole, then to pump cement down the casing, out of the end of the casing and upwardly into the gap between the borehole wall and the outer wall of the casing in order to seal the casing and hold it in place. When the cementing operation is completed, further cylindrical sections of casing of reduced diameter can be passed downwardly through the first casing section. The casing sections (joints) are screwed together so that they extend downwardly from the first section. These procedural steps can be repeated with reducing diameter casing sections. A shoe or float can be placed at the bottom end of the leading casing section. Furthermore, an internal collar can be secured part-way down the length of the leading casing sections.

In conventional primary cementing, cement is forced down the bore of the casing, through an aperture in the guide shoe at the bottom of the casing and up the annulus between the casing and the well-bore to the desired level. One or more float valves are installed in the casing to prevent back flow of the cement into the casing from the annulus if pressure in the casing is reduced and because the density of the cement slurry is normally higher than the density of the displacing mud in the casing. A float valve may be in the form of a collar or as an integral part of the guide shoe. The closed float valve or valves seal the bottom of the casing and prevent fluids in the well-bore from filling it when the casing is lowered into the well-bore. The casing float provides buoyancy in the casing and can reduce total weight supported by the derrick.

After the casing is in place in the well-bore, a bottom cement plug can be pumped before the cement in order to displace any fluid in the casing. The bottom plug can be pumped downwardly through the casing to seat above the uppermost float valve. Thereafter, the pressure is increased in the casing, a diaphragm in the bottom plug is ruptured, and cement flows through the bottom plug, opening the float valve or valves by overcoming the biasing mechanism of the valve. The cement travels to the well-bore annulus. A solid top plug follows the cement and is pumped down by through the casing bore to seat on the bottom plug, at which point the back pressure from the cement in the casing below the float valve, and in the well-bore annulus is supposed to close the valve. When the top plug lands on the bottom plug, the surface pressure increase indicates the end of the cement job.

In conventional cementing, the bottom plug with a rupture disc or the like is usually run ahead of the cement column in the casing. A displacement plug or top plug can be run at the upper end of the column to separate the cement and the displacement fluids. When the bottom plug reaches the shoe at the bottom end of the casing, pressure is used to rupture the disc so that cement slurry can be pumped out of the casing and upwardly into the lower end of the annulus. When the top or displacement plug reaches the shoe, most all of the cement slurry will have been pumped into the annulus. Once the cement has set up or hardened, perforations are shot at one or more intervals in the casing in order to communicate hydrocarbon-bearing formations with the bore of the casing so that the well can be placed on production.

Although the conventional cementing technique has been used for many years, it has a number of shortcomings. The process is time consuming because the cement must be pumped all the way to the bottom of the casing and then back up into the annulus. Expensive chemicals often are used to retard setting of the cement. These factors make conventional cementing a very high cost process which adds considerably to the total completion costs of a well.

One problem which arises when carrying out conventional cementing, is the problem of "free falling" of the cement which occurs during the initial pumping of the cement slurry down the casing. Particularly with larger size casings, the cement slurry falls freely out of control.

There are other drawbacks to conventional cementing which have long plagued oil and gas well production. Prominent among these is that in pumping the cement downwardly to the bottom of the casing and then upwardly into the bore hole annulus to the desired height for the cement column, a considerable period of time is involved. This often results in the use of large concentrations of cement retarder. These conditions can be aggravated by the relatively high temperatures in the bore hole and the water loss from the cement to the formation. In extreme cases, the cement may even set before reaching its destination.

Another drawback in conventional cementing is the weight of the cement, which is heavier than the drilling mud. As the cement travels downwardly in the casing, considerable weight is placed on the casing string. A further problem in conventional cementing, is in pumping the cement upwardly through the annulus from the bottom of the casing or from discharge ports in the side of the casing. In conventional cementing, the pump pressure must be sufficient not only to overcome the resistance to flow of the fluid cement, but also to overcome the weight differential between the cement outside of the casing and the mud inside. These excessive pressures in many cases contribute to the failure in obtaining an annular cement column of adequate height because under high pumping pressures the well walls often fracture, causing loss of the cement to the formation before the cement has sufficiently set.

It is important for the cement to form a strong, continuous annular wall or sheath which bonds the casing to the wall of the well bore. The cement should completely surround the circumference of the casing and should extend uniformly through the vertical length of the annular interval cemented. If the cement is weak, or if any voids are left therein, several undesirable consequences can result. A poor cementing job will not effectively segregate the formations penetrated by the well-bore, and unwanted communication between the formations may occur, sometimes resulting in the production of unwanted fluids. Also, production fluid from a petroleum bearing formation may flow through channels in the cement and into another formation, where it is lost. This is especially disadvantageous when the other formation contains an aquifer. Contamination of the hydrocarbon-bearing formation itself can also occur, such as when salt water channels through the cement and flows into the hydrocarbon-bearing formation. Also, an unsatisfactory cementing job can cause the loss of treatment fluids which are pumped down the well to stimulate production of oil or gas.

In reverse circulation cementing, cement is pumped downwardly into the annulus between the casing and wall of the well bore, without pumping the cement downwardly through the interior of the casing. This has been accomplished by different techniques.

Following the running of the casing, drilling mud is circulated by the mud pump in the conventional manner to pass downwardly through the casing where the mud is discharged through the float shoe. During this initial circulation, the casing can be reciprocated and/or rotated to abrade the wall of the bore hole as well as to remove any accumulated mud cake, which will be carried out along with cuttings and debris by the circulating drilling mud. When an inspection of the rotary mud at the pit indicates that the well is substantially clean, the circulation of mud is then reversed. Once the reverse circulation cycle has been established, the well is ready for cementing. The mud pump is stopped, a spacer fluid is pumped, and a cement slurry is pumped from the cement trucks into the annulus driving the mud ahead of it so that the mud continues to be discharged from the upper end of the casing back to the mud pit.

The reverse cementing operation is continued until such time as the cement has entered the shoe and has begun to flow upwardly into the casing. The moment when this occurs can be determined by observation of the reduction in volume and velocity of mud returns measured at the surface, as well as the variations in pressure registered on pressure gauge. This measurement can be facilitated by providing in or near the shoe a restricted orifice which will cause a more pronounced flow change to appear at the time the cement enters the pipe if the cement is of greater viscosity than the mud. Also, a conventional weight indicator which displays the approximate weight of the pipe and its contents may be used in the suspension system for the casing, in which case the entry of the cement will be reflected by the change in weight of the casing. In the situation where only a partial cementing is contemplated, i.e., where the cement column will be localized somewhere between the top and the bottom of the bore hole, the amount of cement is theoretically calculated in advance in the same manner as is done conventional cementing practices.

The following alternative mode of operation can also be used in reverse cementing some wells. After the initial mud circulation downwardly in the casing and upwardly in the annulus has been established and it appears from examination of the mud being discharged into the mud pit through the line, that the well is substantially clean, the mud pump is stopped and the mud valve is closed. Conditioned mud valve now is opened permitting the conditioned mud to be pumped through the feed line into the upper end of the casing in place of the heavier drilling mud previously circulated. The amount of conditioned mud can vary as desired, depending upon the condition of the well walls, the bottom hole pressure encountered, etc. It often is desirable to pump drilling mud until the reverse circulation is well established and then to shut off the mud pump and begin reverse cementing. The cement slurry preceded by the spacer fluid can immediately be pumped from the cement trucks into the annulus.

The weight differential between the column of fluid inside the casing and that outside assists in initiating and maintaining reverse cement circulation so that less pumping pressure is required and the bottom hole pressure is less than conventional cementing. Additionally, the friction pressure at the bottom of the hole during reverse cementing is much lower then conventional cementing. The cement can be mixed and fed faster, with less pumping power. Because of the lower pressures in reverse cementing, there also is less tendency for the mud or cement to be forced laterally of the bore hole into weak or unconsolidated formation zones near the bottom of the hole. Furthermore, in the event difficulty is encountered due to loss of circulation as sometimes happens in practice, reverse cementing greatly facilitates re-establishment of circulation.

When the walls of the bore hole to be cemented are relatively clean to begin with, or are relatively easy to clean, it is possible to eliminate the preparatory step of circulating conditioning fluid comprising drilling mud downwardly into the upper end of the casing to establish circulation downwardly in the casing and then upwardly in the annulus for the purpose of removing rock cuttings, mud cake, and other debris. When cleaning of the bore hole is completed or not required cementing operation with the circulation of the mud in the reverse direction, can commence by pumping downwardly in the annulus and thereafter upwardly in the casing as has been described. After circulation in this direction has been established, the pump supplying the mud through the line is stopped and the calculated amount of cement slurry is fed after the spacer fluid into the annulus so that the cement travels downwardly to the desired destination. The casing can be reciprocated during the placing of the slurry to abrade cement cake from the walls and maintain an open path for the slurry.

One reverse cementing system has a cementing shoe on the lower end of the casing with a normally closed valve element that can be locked open, when the casing string is run. A check valve is positioned in the casing several joints above the cementing shoe and has a normally open flow ports with downward facing valve seats. Well conditioning fluids comprising drilling mud are pumped down the casing, through the check valve and the cement shoe, and into the annulus so that the annulus can be cleaned up prior to cementing. Then a blowout preventer is closed at the surface and cement slurry is pumped through a line into the annulus. The column of cement can be preceded by a fluid spacer which separates the slurry from the well conditioning fluids, and an injector is used to place a plurality of balls or ball discs in the annulus at the front of the cement column or at the top of the mud spacer. The spacer and slurry pass downward into the annulus between the casing and the borehole wall and then over the lower end of the casing via the locked-open valve in the cement shoe. When the balls or discs reach the valve seats in the check valve, they lodge in the valve seats to prevent upward flow therethrough. When this occurs a positive indication is given at the surface in the form of a pump pressure increase and/or cessation of mud flow. The cementing job is then complete, and the pressure can be bled off at the surface. It has been suggested to drop a test ball down the casing on an upwardly facing valve seat on the check valve so that internal pressure can be applied to the casing string to test for leaks.

Reverse circulation cementing is currently being used in the field almost exclusively in relatively shallow wells. In these applications, cementing is performed by taking returns through an inner string run inside the casing after getting the casing to bottom. The inner string stings into a tool at the bottom of the casing. The valve in the tool closes after the inner string is un-stung from the tool after the end of the cement job.

Some prior reverse float equipment in shallow well applications have used a retainer at the bottom of the casing, in conjunction with the use of an inner string. Returns are taken during the job through the inner string. At the end of the job, the inner string is pulled from the tool to close the valve at the bottom of the casing, allowing the cement to set without having to apply pressure to the casing. For deeper applications, running an inner string is not operationally easy and in many cases undesirable. Therefore, new float equipment is needed to be able to use reverse circulation cementing for deeper applications without the use of an inner spring and without the application of pressure to the casing after the end of the cement job.

It is therefore, desirable to provide an improved reverse circulation float equipment tool and process, which overcomes most, if not all, of the preceding problems.

SUMMARY OF THE INVENTION

An improved reverse circulation float equipment tool and process are provided which is especially useful in deeper oil and gas wells but can also be used in shallow well applications. Advantageously, the user-friendly reverse circulation float equipment tool and process are efficient, economical and effective. Desirably, the convenient reverse circulation float equipment tool and process are easy to use, reliable, safe, and attractive.

The novel reverse circulation equipment tool can provide a float, shoe, or collar, for attachment to a casing. The inventive reverse circulation equipment tool can have: an upper section with a ball-activated upper valve, a lower section with a ball-activated lower valve, and a ball chamber which extends between and communicates with the upper and lower sections to contain the ball in a reverse mode.

The upper valve can be moved by a ball within the casing from a first position in a conventional mode to permit conventional flow of conditioning fluid downwardly through the casing and upwardly through an annulus between the casing and the wall of the well bore, to a second position in a reverse mode for reverse flow of the conditioning fluid and a cement slurry down the annulus, as well as to permit upward passage of conditioning fluid in the casing. The upper valve can have at least one shearable member, preferably a spring-biased member, such as an arm or bar. Desirably, a shear pin can detachable secure the member in the first position in the conventional mode and a spring can urge the member to the second position in the reverse mode. In the preferred form, the upper valve has symmetrical pivotable arms.

The lower valve is moveable by a ball within the casing from a normally open position to permit downward flow and upward flow of fluid in the casing during the reverse mode, to a closed position to substantially prevent flow in both the reverse and conventional modes. The lower valve can comprise a tube section, such as an annular cylinder, sleeve, or pipe, to permit flow in the conventional and reverse mode.

At least one lower shear pin can removably secure the tube section in the open position in the conventional and reverse modes. In the preferred form, the lower valve comprises: a valve seat, a ball valve connected to the tube section, and a compression spring to urge the ball valve to close against the valve seat after the ball engages and drives the tube section downwardly to shear the lower pin.

In the improved reverse circulation process, the annulus is first cleaned by passing a conditioning fluid, such as drilling mud, followed by lower viscosity diluted drilling mud or conditioned mud, through the annulus to remove drill cuttings and other debris in the annulus. The conditioning fluid can be pumped down the casing and up through the annulus in the convention mode, and/or can be pumped down the annulus and up through the casing in the reverse mode without an inner string in the casing. After the annulus has been cleaned, a cement slurry is pumped down the annulus in the reverse cementing mode (without a drill string in the casing) and the cement is allowed to set.

In the preferred process, a float is attached to at least one section of the casing and the casing is lowered with the float in the well bore. Before reverse cementing, a ball is dropped in the well bore to trigger an upper valve in the float so as to prevent conventional downward flow of mud or cement in the casing. The lower valve in the float is closed by the ball after reverse cementing to prevent flow of cement and conditioning fluid through the float. Desirably, in the process, the ball shears at least one pin in the float.

The reverse circulation float equipment tool and process permit the application of reverse circulation cementing in shallow and deeper wells, without having to use an inner string. The new tool and process allow circulation in the normal and reverse circulation modes while running the casing and during hole conditioning. After the reverse circulation job, the convenient user-friendly tool and process allow closing of the bottom of the casing to prevent U-tubing of the cement slurry. This will also facilitate having the casing in radial compression during the time required to set the cement (WOC time) to minimize the formation of a micro-annulus during cement curing.

The reverse circulation cementing tool and process are a very viable alternative to conventional cementing particularly in situations were weak formations may be broken down during normal cementing because of excessive pressures in the annulus. The reverse circulation cementing tool and process generate much lower job pressures.

A more detailed explanation of the invention is found in the following description and appended claims taken in conjunction with the accompanying drawings.

DETAILED DESCRIPTION OF THE PREFERRED EMBODIMENT

Figure 1:
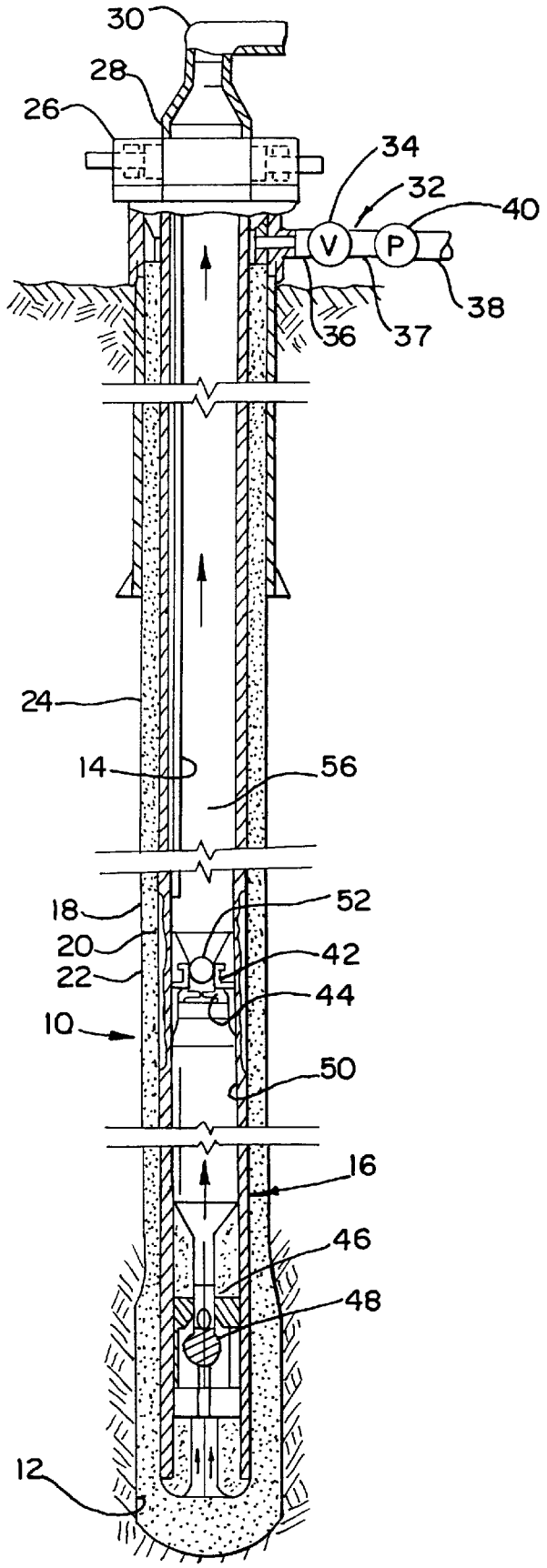
FIG. 1 is a schematic diagram of an oil or gas well with various equipment including a reverse circulation float equipment tool in accordance with principles of the present invention.

FIG. 1 illustrates a well 10, such as an oil or gas exploration or production well. The well has a well bore 12 providing a hole into which is placed in a casing 14 or pipe. The casing is constructed of a string of casing sections or joints which are lowered and secured together in the well bore. To facilitate lowering of the casing, the lower section or nose of the casing has a drillable reverse circulation float equipment tool 16 attached thereto. An annulus 18 provides an annular chamber or channel between the outer surface 20 of the casing and the wall 22 of the well bore. The annulus is filled or partially filled with cement 24 comprising a cement slurry which has been pumped, set and hardened in the manner herein described. The cement fixedly secures the casing and prevents migrations of hydrocarbons and other fluids in the annulus, so as to enhance production well performance and recovery of hydrocarbons.

A blowout preventer 26 (FIG. 1) can be positioned on the well above the ground about an overhead line 28 and conduit 30. A manifold 32 has an array or series of valves 34 connected via pipes 36–38 and pumps 40 to reservoirs, tanks or trucks, containing drilling fluid, also referred to as drilling mud, conditioned mud comprising less viscous thinner drilling mud, spacer fluid, and cement slurry. The manifold can also be connected by one or more valves, via pipes and a pump, to a mud pit. The manifold valves, pipes, overhead line and reverse circulation float equipment tool cooperate with each other to provide reverse circulation equipment for the process herein described.

The reverse circulation float equipment tool is fastened, or otherwise secured to the lower sections and nose of the casing. The reverse circulation float equipment tool has an upper section 42 (FIG. 1) with a ball-activated upper valve 44, a lower section 46 with a ball-activated lower valve 48, and an intermediate elongated ball chamber 50 which extends between and communicates with the upper and lower sections to contain a drillable ball 52 in a reverse mode.

Figure 2:
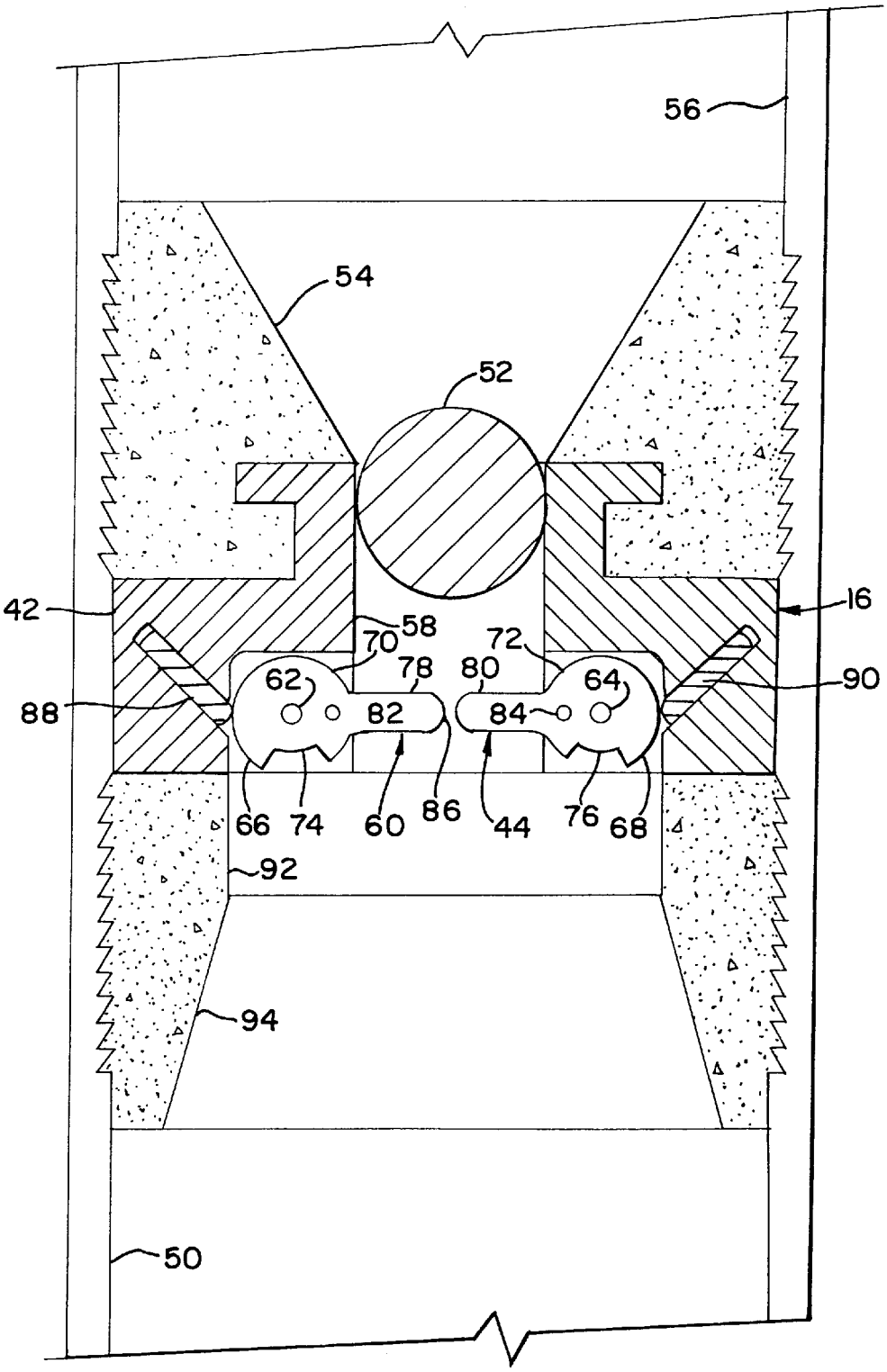
FIG. 2 is a cross-sectional view of the upper section of the reverse circulation float equipment tool in a conventional mode.

As shown in FIG. 2, the upper section of the reverse circulation float equipment tool has an upwardly diverging, flared passageway 54 which extends between and communicates with the interior passageway 56 of the casing and an upper throat 58 that provides a reduced diameter passageway in the upper section. The flared passageway and throat receive the ball 52 after the annulus (between the casing and wall of the well bore) has been cleaned with conditioning fluid. The upper valve 46 comprises symmetrical, complementary pivotable arm assemblies 60. The arm assemblies are moveable by the ball from: (1) a first open position in a conventional and reverse modes as shown in FIG. 2 to permit flow of conditioning fluid downwardly and upwardly through the casing and upwardly and downwardly through the annulus, to (2) a second position in a reverse mode as shown in FIG. 3 to accommodate reverse flow of conditioning fluid down the annulus while permitting upward flow of conditioning in the interior passageway of the casing.

Each of the pivotable arm assemblies of the upper section of the reverse circulation float equipment tool has a: pivot pin 62 or 64 and a rounded central portion 66 or 68, which is pivotally attached to the pivot pin. Each rounded central portion has a convex rounded arcuate section 70 or 72 which provides a cam and has a recessed undercut section 74 or 76 comprising a cavity which provides a spring-receiving chamber. Each of the pivotable arm assemblies has an elongated arm 78 or 80, that provides a finger or bar, which extends integrally inwardly into the throat and is cantilevered from the rounded central portion. An upper shear pin 82 or 84 removably, releasably and detachably secures the arm in the first position in the conventional mode such that the arms are diametrically opposite and horizontally aligned in registration with each other across the throat, as shown in FIG. 2, with a small gap 86 or spacing between the arms to assist in providing a passageway for flow of fluid therebetween. An upper compression spring 88 or 90 or spring-biased rod engages and rides upon the cam in the first position as shown in FIG. 2 and engages and seats within the spring-receiving chamber to urge the arms to the second position in the reverse mode as shown in FIG. 3.

Figure 3:
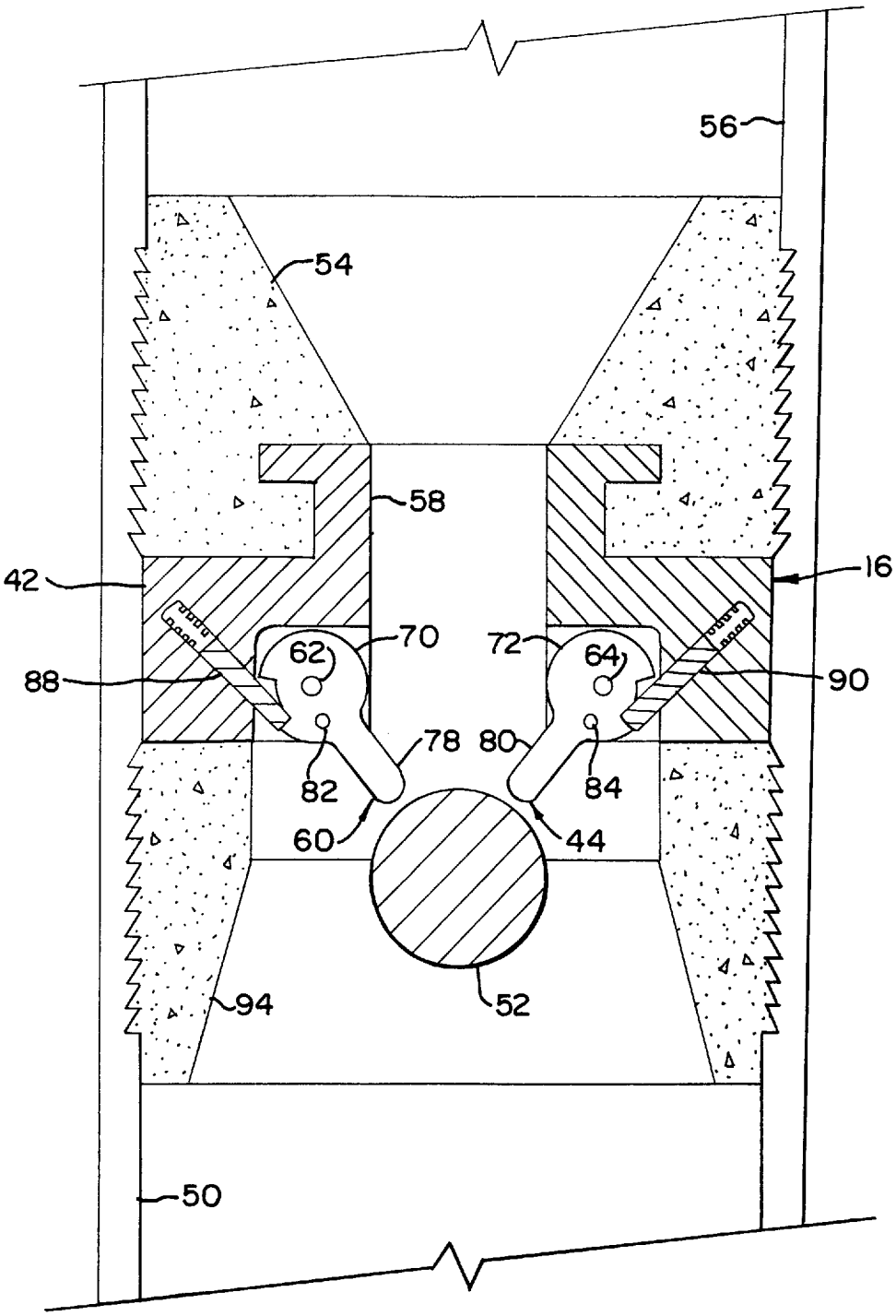
FIG. 3 is a cross-sectional view of the upper section of the reverse circulation float equipment tool in a reverse mode.

Positioned below and communicating with throat, at a level below the pivot pins and rounded central portions of the pivotable arm assemblies, is a larger diameter passageway 92 (FIGS. 2 and 3). A downwardly diverging upper flared passageway 94 extends between and communicates with the larger diameter passageway and an upper portion of the intermediate ball chamber 50. If desired, the flared passageways can extend directly to the walls of the passageway to which they communicate.

Figure 4:
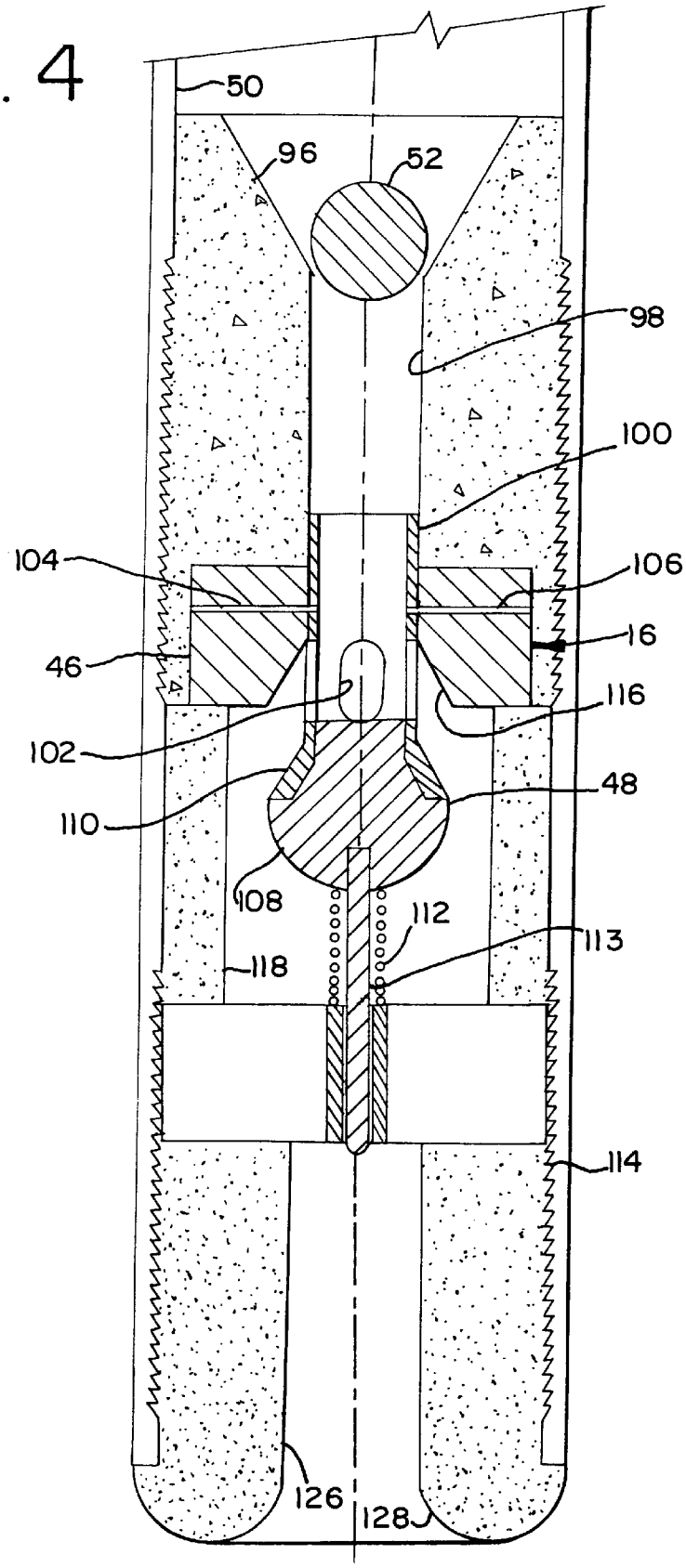
FIG. 4 is a cross-sectional view of the lower section of the reverse circulation float equipment tool in a reverse mode.

As shown in FIG. 4, a downwardly diverging lower flared passageway 96 extends between and communicates with the lower portion of the intermediate ball chamber and a lower throat 98 to provide a reduced diameter passageway in the lower section of the reverse circulation float equipment tool. In the lower section of the reverse circulation float equipment tool, a lower flow cylinder 100 which can comprise a sleeve or annular flow cylinder, provides a tube section with apertures 102 at its lower end. The apertures can comprise oval slots or holes to permit passage of conditioning fluid upwardly in the casing in the conventional and reverse modes as shown in FIG. 4. One or more lower shear pins 104 and 106 are provided to releasably, removably and detachably secure the lower flow cylinder to an open position in the reverse and conventional modes as shown in FIG. 4. A ball valve 48 with a convex semi-circular rounded bottom portion 108 and an upwardly flared frustro-conical portion 110 is integrally secured to and positioned below the lower flow cylinder.

Figure 5:
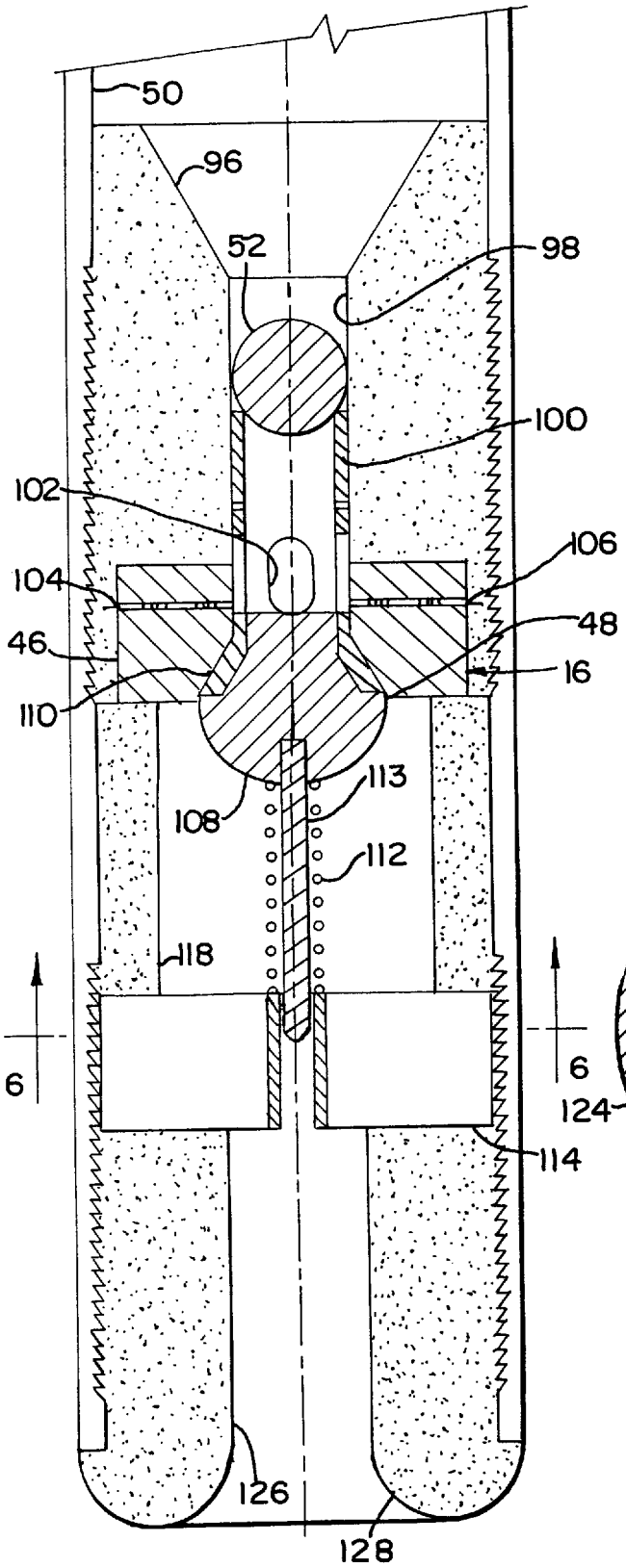
FIG. 5 is a cross-sectional view of the lower section of the reverse circulation float equipment tool with the lower valve closed after reverse cementing.
Figure 6:
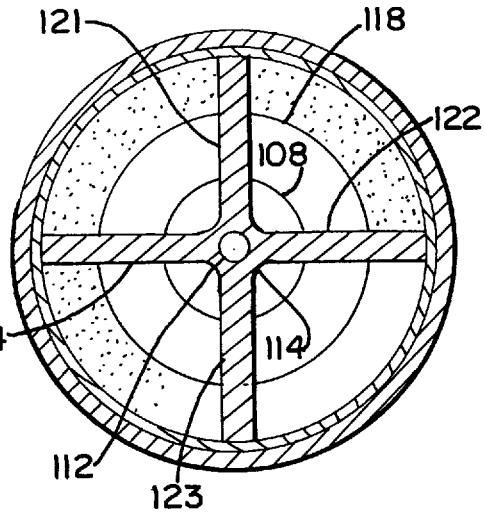
FIG. 6 is a transverse cross-sectional view of the lower section of the reverse circulation float equipment tool taken substantially along line 6—6 of FIG. 5.

A lower compression spring 112 (FIGS. 4 and 5) surrounds an elongated shaft 113 which extend between and connects the bottom portion of the ball valve to a fixed cross-sectional shape mechanism or transverse bar 114 (FIGS. 5 and 6). The transverse bar provides a stationary fixed block or anchor. The lower compression spring urges the flared portion of the ball valve against a downwardly converging flared ball seat 116, as shown in FIG. 5, after the ball strikes the flow cylinder with sufficient force to cause the flow cylinder to shear the lower pins upon completion of the reverse mode so as to prevent passage of conditioning fluid and cement through the float tool and casing.

Positioned below and communicating with the lower throat, when the ball valve is open as shown in FIG. 4, is a lower larger diameter passageway 118. The bottom portion of the ball valve is positioned in the lower larger diameter passageway. The cross-shaped transverse bar has four 90 degree arcuate pie-shaped passageways 121–124 as viewed from the bottom of the reverse circulation float equipment tool as shown in FIG. 6. The pie-shaped passageways are positioned between and communicate with the larger diameter passageway and a lower reduced diameter passageway 126. The lower portion of the reduced diameter passageway can have a rounded downwardly diverging flared passageway 128, which provides a reverse inlet throat.

All the passageways in the reverse circulation float equipment tool are concentric and communicate with the interior passageway of the casing in the conventional mode.

As described above, the reverse circulation float equipment tool valve has two sections with upper and lower tool seats. The lower seat contains the valve that closes at the end of the reverse circulation cement job. The space between the two seats comprises a ball chamber. The two seats can be located at a reasonable distance from each other, for example 20 to 40 feet. FIG. 2 illustrates the upper seat. FIG. 4 illustrates the lower seat with the valve in its open position. In these two figures, the drillable ball is shown but while circulating and cleaning the hole in the conventional mode down the casing, or the reverse mode down the annulus, the ball has not been dropped, and therefore, the bottom of the casing is open to circulation in either direction. When the valve is pinned by the lower shear pins in its open position, the casing can be circulated in either direction at any rate including high rates without concerns of closing the valve.

The primary purpose of the upper seat (FIG. 2)is to trap the drillable ball in the ball chamber, so that the ball will be in close proximity to the lower valve after the reverse circulation cement job. Once the hole has been fully cleaned and conditioned in the conventional and/or reverse circulation mode, the ball is dropped and passed to the upper seat (FIG. 2). The ball then enters the upper seat throat and seals the flow opening.

Application of a preset pressure which is detectable at the surface, shears the pins holding the two shear-arms (pivotable arms) which provide retainer bars or a baffle collar and allows the ball to enter the ball chamber (FIG. 3). The spring-loaded shafts with the upper springs located on the side of the shear-arms prevent them from returning to their close position, to keep the ball from seating on the lower opening of the upper seat flow channel. The reason for the extensive length of the ball chamber (e.g. 20 to 40 feet) is to make sure that when shearing the shear-arm pins (upper shear pins), the ball does not go down and also shears the valve pins (lower shear pins) located in the lower seat.

Once the ball is trapped in the ball chamber, circulation can only be performed in the reverse circulation mode. At this point, reverse circulation is again established in the reverse direction, followed by the reverse circulation cementing job. At the end of the reverse circulation cement job, the ball is near the valve since it is trapped in the ball chamber. After stopping the pumps and switching to pressurize the casing, the ball is forced, by applying a preset pressure in addition to the hydrostatic differential and after pumping a small volume of fluid, to shear the lower flow cylinder pins (lower shear pins) that hold the valve open. After shearing the lower shear pins, releasing of the pressure in the casing causes the spring activated ball valve to close. The hydrostatic differential holds the valve close after the job.

In order to drill, prepare and construct oil and gas wells using the reverse circulation float equipment tool and process, a well bore is first drilled, such as 15,000 to 20,000 feet, with a drill bit on a drill string (drill pipe) while concurrently circulating drilling mud in the well bore to carry rock cuttings from the well bore to the surface. After drilling, the drill string is removed from the well bore. The reverse circulation float equipment tool is then attached to the nose and lower sections of the casing and the casing with the reverse circulation float equipment tool is lowered into the well bore and secured in place. After the casing is positioned in the well bore, the annulus between the casing and wall of the well bore is cleaned to remove drill cuttings and other debris in the annulus. The annulus can be cleaned by opening conventional mode conditioning fluid valves of the manifold and sequentially passing conditioning fluids comprising drilling mud followed by conditioned drilling mud preferably lower viscosity thinner drilling mud, in a conventional mode downwardly through both the interior passageway of the casing and the reverse circulation float equipment tool and upwardly through the annulus.

After the annulus has been cleaned in a conventional mode, the conventional mode conditioning fluid valves are closed and the ball is dropped down the casing. The ball will fall and lodge in the upper throat. The ball will quickly pass through the upper throat and contact and push the pivotable arms with sufficient pump pressure to shear the upper shear pins and close the upper valve of the upper section of the reverse circulation float equipment tool by moving and pivoting the arms to a downward second position in the reverse mode as shown in FIG. 3. Shearing of the upper shear pins causes a pressure spike in the pressure gauge viewed by the operator. The conventional mode conditioning fluid valves are closed and the reverse mode conditioning fluid valve of the manifold is then opened to pump conditioned drilling mud in the reverse mode down the annulus and upwardly through the reverse circulation float equipment tool into the casing. During the reverse mode, the ball is trapped in the ball chamber.

When the reverse mode has been comfortably established so that the conditioned drilling mud circulates freely in the reverse mode, the reverse mode conditioning fluid valve is closed and the spacer fluid valve of the manifold is opened to pump a spacer fluid (interface fluid) down the annulus in the reverse mode behind the conditioned drilling mud. The spacer fluid can be 100–1000 annular linear feet in depth or other depths.

After the spacer fluid has been pumped down the annulus, the space fluid valve is closed and the reverse mode cement valve of the manifold is opened to pump a cement slurry in the reverse mode down the annulus. After a sufficient quantity of cement slurry has been pumped into the annulus based upon the volume and size of the annulus, the cement valve is closed. In some circumstances, it is desirable that the head of the cement slurry (contaminated front) enter the bottom of the casing to assure that the lower portion of the annulus is completed filled with the desired good quality cement slurry. The spacer fluid valve can then be opened again to pump spacer fluid on top of the cement slurry. The spacer fluid valve is then closed and the displacement mud is then pumped until the cement slurry is in place.

Thereafter, the lower ball valve of the lower section of the reverse circulation float equipment tool is closed by opening the conventional mode mud valve of the manifold to back pressure the casing and pump drilling mud or conditioned mud down the casing. Back pressuring the casing will push the ball down the lower throat to strike the top of the flow cylinder with sufficient force to shear the lower shear pins. The operator will know that the lower shear pins have been sheared from a pressure spike on the pressure gauge. When the shear pins are broken or snapped (sheared) and the surface casing pressure is released, the lower compression spring will push and urge the ball valve against the valve seat to close the ball valve of the reverse circulation float equipment tool. Closure of the ball valve prevents fluid, such as drilling mud and cement slurry from passing upwardly or downwardly through the reverse circulation float equipment tool. Upon closure of the ball valve, the conventional mode mud valve is closed. The job is closed, finished and completed.

The cement slurry in the annulus is then allowed to set, cure and harden. After the cement is set, the reverse circulation float equipment tool and ball, as well as any cement in the casing, are drilled with a polycrystalline diamond contact (PDC) drill bit or other drill bit, if further sections of casings are to be lowered below the existing casing.

Advantageously, the reverse circulation float equipment tool can be used for reverse circulation cementing at any well depth. Desirably, the reverse circulation float equipment tool will allow circulation in the normal and reverse circulation modes while running the casing and during hole conditioning.

During reverse circulation cementing, wells may tend to go on vacuum or free fall. During free fall, the fluids move at rates that are different from the surface pump rates. In reverse circulation cementing, it is advisable to minimize free fall by pumping at rates high enough to prevent the well from going on vacuum. This will decrease the chances of the heavier fluids channeling down through the lighter fluids as they move down the annulus.

The upper and lower sections of the reverse circulation float equipment tool can each be 4–5 feet in length. The ball chamber can be 20–40 feet in length. Other sizes and lengths can be used, if desired.

The drillable float equipment valve tool and process have been designed that will permit the application of reverse circulation cementing in shallow or deeper wells, without having to use an inner string. The float equipment valve tool and process permit circulation at any rate in the conventional and reverse circulation modes. After the reverse circulation cement job, by the action of a ball, the reverse circulation float equipment tool and process will allow closing of the bottom of the casing to prevent the cement slurry from U-tubing into the casing. This will also facilitate having the casing in radial compression during the time required for the cement in the annulus to set (WOC time) to minimize the formation of a micro-annulus during cement curing.

Reverse circulation in general requires lower surface pumping pressures (lower horse power requirements) during the cement job than the conventional pumping approach. In the reverse circulation mode, the difference between the hydrostatic pressure in the annulus (PHA) and the hydrostatic pressure in the casing (PHC) term (PHA–PHC) is always positive and contributes to reducing the surface pressure needed during the entire job. The reverse circulation process and tool yield lower annular pressures than the conventional circulation method. The reverse circulation process and tool are even more attractive from the point of view of reducing annular placement pressures during cement jobs, with increasing cement slurry densities and increasing annular friction pressures. Large friction pressures are likely in narrow annuli. Therefore, the reverse circulation process and tool are also quite attractive in slim hole applications. Also, reverse circulation process and tool can allow execution of some cement jobs across weak zones without breaking down those formations, as sometimes happens with conventional cementing.

Among the many advantages of the reverse circulation cementing process and tool are:

1. Much lower placement pressures across lower weak zones during hole conditioning and during cementing provides a primary advantage. Because of this, the technique and tool can produce good cement jobs in situations where the conventional method would fail.

2. Decreased placement pressures allow faster placement rates when needed for better displacement without breaking down weak formations.

3. Lower surface pump equipment requirements.

4. Quicker cement jobs because the cement slurry is pumped down the annulus directly, instead of being pumped down the casing and up the annulus.

5. Because of the way the cement slurry is pumped, not all of the cement slurry is exposed to the high well temperatures located toward the bottom of the well. This simplifies the cement slurry design.

6. Placement times are shorter.

7. Use of less additives such as retarders, fluid loss, gas migration materials, etc.

8. Additives can be staged.

9. Lower slurry densities can be used.

10. Less expensive cement slurrying.

11. Lower cement job costs.

12. Economical.

13. Convenient.

14. User-friendly.

15. Efficient

16. Effective.

Although embodiments of the invention have been shown and described, it is to be understood that various modifications and substitutions, as well as rearrangements of parts, components, equipment, and process steps, can be made by those skilled in the art without departing from the novel spirit and scope of this invention.

What is claimed is:

1. Reverse circulation equipment for use in oil and gas wells, comprising:

a tool for attachment to a casing, said tool comprising an upper section with a ball-activated upper valve, said upper valve being moveable by a ball within said casing from a first position in a conventional mode for permitting conventional flow of conditioning fluid downwardly through a casing and upwardly through an annulus between said casing and a wall of a well bore, to a second position in reverse mode for reverse flow of said conditioning fluid and a cement slurry downwardly in said annulus and for passing said conditioning fluid upwardly through said casing;

a lower section with a ball-activated lower valve, said lower valve being moveable by a ball within said casing from a normally open position for permitting upward flow of fluid in said casing during said reverse mode to a closed position to substantially prevent flow in both said reverse mode and conventional mode;

a ball chamber extending between and communicating with said upper and lower sections for containing said ball in said reverse mode;

said upper valve having at least one shearable member; and a shear pin to detachably secure said shearable member in said first position providing said conventional mode and a spring to urge said shearable member to said second position providing said reverse mode.

2. Reverse circulation equipment in accordance with claim 1 wherein said shearable member comprises a spring-biased member.

3. Reverse circulation equipment in accordance with claim 2 wherein said spring-brand member is selected from the group consisting of an arm and a bar.

4. Reverse circulation equipment in accordance with claim 1 wherein said ball-activated lower valve comprises a tube section for permitting flow in said reverse mode and at least one shear pin for removably securing said tube section in said normally open position in said reverse mode.

5. Reverse circulation equipment in accordance with claim 4 wherein said tube section of said ball-activated lower valve is selected from the group consisting of an annular cylinder, sleeve, and pipe.

6. Reverse circulation equipment for use in oil and gas wells, comprising:

a tool for attachment to a casing, said tool comprising an upper section with a ball-activated upper valve, said upper valve being moveable by a ball within said casing from a first position in a conventional mode for permitting conventional flow of conditioning fluid downwardly through a casing and upwardly through an annulus between said casing and a wall of a well bore, to a second position in reverse mode for reverse flow of said conditioning fluid and a cement slurry downwardly in said annulus and for passing said conditioning fluid upwardly through said casing;

a lower section with a ball-activated lower valve, said lower valve being moveable by a ball within said casing from a normally open position for permitting upward flow of fluid in said casing during said reverse mode to a closed position to substantially prevent flow in both said reverse mode and conventional mode;

a ball chamber extending between and communicating with said upper and lower sections for containing said ball in said reverse mode;

said upper valve having substantially symmetrical pivotable arms, shear pins for shearably securing said arms in said first position providing said conventional mode, and springs for urging said arms in said second position providing said reverse mode after contact by said ball and shearing of said pins.

7. Reverse circulation equipment in accordance with claim 6 wherein said ball-activated lower valve comprises:

a valve seat;

a tube section comprising an annular cylinder with apertures for permitting upward flow through said casing in said reverse mode;

at least one shear pin for shearably securing said tube section in said normally open position;

a ball valve connected to said tube section for positioning against said valve seat in said closed position; and a compression spring for urging said ball valve against said valve seat after said ball has engaged said tube section and sheared said pin.

8. Reverse circulation equipment for use in oil and gas wells, comprising:

a reverse circulation float tool for attachment to a casing in a well bore, said float tool comprising an upper section with a throat for receiving a ball after an annulus between said casing and a wall of said well bore has been substantially cleaned with a conditioning fluid, said upper section having an upper valve comprising substantially symmetrical pivotable arm assemblies, said arm assemblies being moveable by said ball from a first open position in a conventional mode for permitting flow of said conditioning fluid downwardly through said casing and upwardly through said annulus, to a second position in a reverse mode for reverse flow of conditioning fluid and a cement slurry down said annulus while permitting upward flow of said conditioning fluid in said casing;

said pivotable arm assemblies each comprising a pivot pin, a rounded central portion pivotally attached to said pivot pin, said rounded central portion having a convex arcuate section providing a cam and a recessed section comprising a cavity providing a spring-receiving chamber, an arm integrally extending and cantilevered from said central portion, an upper shear pin for removably securing said arm in said first position in said conventional mode, and a spring for engaging and riding upon said cam in said first position in said conventional mode and for engaging said spring-receiving chamber to urge said arms to said second position in said reverse mode;

a lower section having a lower flow cylinder comprising a sleeve with apertures for permitting passage of conditioning fluid upwardly in said casing in said reverse mode, a lower shear pin for releasably securing said flow cylinder to an open position in said reverse mode, a valve seat, a ball valve secured to and positioned below said flow cylinder, a compression spring to urge said ball valve against said seat to close said ball valve after said ball strikes said flow cylinder with sufficient force to cause the flow cylinder to shear said lower shear pin upon completion of said reverse mode to substantially prevent passage of conditioning fluid and cement through said float tool and casing; and a ball chamber extending between and communicating with said upper and lower sections for containing said ball in said reverse mode.

9. A process for use in oil and gas wells, comprising the steps of:

substantially cleaning an annulus between a casing and a wall of said well bore to substantially remove drill cuttings and debris therein by passing a conditioning fluid through said annulus;

attaching a float to at least one section of said casing; lowering said casing with said float in said well bore;

dropping a ball down said casing in the absence of said drill string before said reverse cementing to trigger a valve in said float;

reverse cementing said annulus by pumping a cement slurry down said annulus in the absence of a drill string in said casing;

substantially preventing downward flow of cement in said casing with said valve after said valve has been triggered by said ball; and allowing said cement to set in said annulus.

10. A process in accordance with claim 9 wherein said conditioning fluid is pumped down said casing and up through said annulus.

11. A process in accordance with claim 9 wherein said conditioning fluid is pumped down said annulus and up through said casing.

12. A process in accordance with claim 9 wherein said conditioning fluid is selected from the group consisting of drilling mud, lower viscosity diluted drilling mud, conditioned mud, spacer fluid, and combinations thereof.

13. A process in accordance with claim 9 including shearing at least one pin in said float with said ball.

14. A process in accordance with claim 9 including substantially preventing flow of cement and fluid through said float after said reverse cementing by closing another valve in said float with said ball.

15. A process for use in oil and gas wells, comprising the steps of:

drilling a well bore with a drill bit on a drill string while concurrently circulating drilling mud in said well bore to carry cuttings from said well bore to the surface;

removing said drill string from said well bore;

attaching a float tool to at least one section of a casing, said float tool having an upper valve section, a lower valve section and an intermediate ball-receiving chamber between said upper and lower valve sections;

lowering said casing into said well bore with said float tool;

substantially cleaning an annulus between said casing and a wall of said well bore to substantially remove drill cuttings and some other debris from said annulus by sequentially passing drill mud and a conditioned drilling mud having a lower viscosity than said drilling mud, downwardly through said casing and float tool and upwardly through said annulus;

dropping a ball down said casing to shear and close an upper valve in said upper valve section of said float and passing said ball to said ball-receiving chamber after said annulus has been substantially cleaned;

reversing the flow of conditioned drilling mud by pumping said conditioned drilling mud downwardly in said annulus and upwardly into said casing;

pumping a spacer fluid down said annulus behind said conditioned drilling mud;

reverse cementing said annulus by pumping a cement slurry down said annulus;

substantially preventing cement from passing through said float tool after said reverse cementing by closing a lower valve in said lower section of said float tool by back pressuring said casing and pumping mud down said casing until said ball causes shearing of a pin in said lower valve;

substantially releasing said back pressure; and allowing said cement to set in said annulus.

16. A process in accordance with claim 15 including drilling said float tool and said ball with a polycrystalline diamond compact drill bit or other drill bit after said cement has set.

* * * * *

UNITED STATES PATENT AND TRADEMARK OFFICE

CERTIFICATE OF CORRECTION

PATENT NO. : 5,890, 538

DATED : Apr. 6, 1999

INVENTOR(S) : Robert M. Beirute; John W. Kearns, Jr.

It is certified that error appears in the above-indentified patent and that said Letters Patent is hereby corrected as shown below:

| Col. | Line | |
|---|---|---|
| 14 | 2 | "said spring-brand member"<br><br>should read:<br>"said spring-biased member" |

Signed and Sealed this

Twelfth Day of October, 1999

*Attest:*

Q. TODD DICKINSON

*Attesting Officer*

*Acting Commissioner of Patents and Trademarks*